United States Patent [19]

Shafirkin

[11] Patent Number: 5,024,071

[45] Date of Patent: Jun. 18, 1991

[54] CODING ASSEMBLY FOR LOCKLIKE DEVICES

[76] Inventor: David I. Shafirkin, ulitsa Egerskaya, 5, korpus 1, kv. 110, Moscow, U.S.S.R.

[21] Appl. No.: 430,530

[22] Filed: Nov. 1, 1989

[30] Foreign Application Priority Data

Oct. 14, 1988 [SU] U.S.S.R. ..... 4493189

[51] Int. Cl.[5] ..... E05B 35/04

[52] U.S. Cl. ..... 70/387; 70/352; 70/409

[58] Field of Search ..... 70/387, 393, 397, 398, 70/401, 407, 409, 350–352

[56] References Cited

U.S. PATENT DOCUMENTS

| | | | |
|---|---|---|---|
| 690,191 | 12/1901 | Saxe | 70/352 |
| 1,366,161 | 1/1921 | Clark | 70/409 |
| 1,527,336 | 2/1925 | Voda | 70/387 X |
| 2,302,414 | 11/1942 | Buchanan-Wollaston | 70/387 X |
| 2,595,267 | 5/1952 | Julliard | 70/387 |
| 4,388,815 | 6/1983 | Lawler | 70/387 X |

FOREIGN PATENT DOCUMENTS

| | | | |
|---|---|---|---|
| 266249 | 10/1913 | German Democratic Rep. | 70/351 |
| 500342 | 1/1976 | U.S.S.R. | 70/351 |

*Primary Examiner*—Robert L. Wolfe
*Assistant Examiner*—Suzanne L. Dino
*Attorney, Agent, or Firm*—Burgess, Ryan and Wayne

[57] ABSTRACT

The coding assembly comprises a body, a removable cross bar and a key having coding pins. According to the invention, the side surface of the homing head is provided with at least one longitudinal rib. The cross-sectional profile of the longitudinal rib corresponds to the cross-sectional profile of the coding recesses, the depth of which corresponds to the height of the longitudinal rib. Moreover, each securing pin has at least one additional recess, the cross-sectional profile of which corresponds to the cross-sectional profile of the longitudinal rib, and the depth is smaller than the height of the longitudinal rib.

10 Claims, 4 Drawing Sheets

CODING ASSEMBLY FOR LOCKLIKE DEVICES

TECHNICAL FIELD

The present invention relates to devices which provide secrecy and blocking of locklike devices by mechanical means, and more specifically to a coding assembly of locklike devices.

The present invention can be used most advantageously in locklike devices which can be used to lock wagons, containers, warehouses, living apartments, garages, etc.

BACKGROUND ART

Known in the art is a coding assembly for locklike devices (US, A, 1,527,336), which comprises a body, a cross bar and a key with coding pins. The body is provided with a main cavity and additional cavities communicating therewith. The longitudinal axis of each of the additional cavities is perpendicular to the longitudinal axis of the main cavity.

The cross bar made in the form of a clamp is capable of longitudinal displacement within the body. The cross bar is provided with a homing head designed to be received in the main cavity of the body. The homing head is provided with recesses.

Each additional cavity of the body houses a securing pin capable of limited longitudinal displacement and having a coding recess on its side surface. The longitudinal displacement of the securing pins is effected by means of springs cooperating therewith and each received in the additional cavity between the bottom thereof and the end face of the securing pin. The longitudinal displacement of the securing pins toward the outer surface of the body is limited by pegs fixed in the body and housed in through slots made in the securing pins.

Each of the code recesses provided on the side surface of the securing pin has a cross-sectional profile corresponding to the profile of the recesses in the cross bar homing head intended to block the cross bar in the body.

The coding pins of the key are rigidly fixed to a bearing piece, or plate, in a perpendicular relation to its surface. The number of the coding pins corresponds to that of the securing pins.

The prior art coding assembly makes it possible to block an object with a certain degree of secrecy and reliability. However, the recesses provided in the securing pins, each of them being a working one, permit unauthorized opening of the locklike device by searching the positions of the recesses in the securing pins.

The pegs provided for limiting the longitudinal displacement of the securing pins allow the latter to be removed by shearing the peg with a blow on the securing pin. The cross bar in the form of a clamp allows the locklike device to be thrown off the guarded object with the help of a lever or by a blow delivered on it. Besides, the rigid locking of the cross bar makes it easy to saw the cross bar with the help of a hack saw, which is yet another factor lowering the reliability of the locking of the object guarded.

OBJECTS AND A BRIEF DISCLOSURE OF THE INVENTION

It is an object of the present invention to ensure a high degree of secrecy of a locklike device.

Another object of the invention is to minimize the possibility of unauthorized removal of the locklike device from the object guarded by mechanical effort.

These and other objects are attained in a coding assembly for locklike devices, comprising a body provided with a main cavity and additional cavities which communicate therewith and the longitudinal axis of each of which is perpendicular to the longitudinal axis of the main cavity, a removable cross bar having a homing head intended to be received in the main cavity of the body and to interact with securing pins, each of which is capable of limited longitudinal displacement in the respective additional cavity and has a coding recess in the side surface thereof, and a key designed to interact with the securing pins and having coding pins allowing the homing head to move out of the body owing to the arrangement of all the coding recesses in one plane passing through the longitudinal axis of the homing head, wherein, according to the invention, the side surface of the homing head is provided with at least one longitudinal rib, the cross-sectional profile of which corresponds to the cross-sectional profile of the coding recesses, the depth of which corresponds to the height of the longitudinal rib, and each of the securing pins has at least one additional recess, the cross-sectional profile of which corresponds to the cross-sectional profile of the rib, and the depth is less than the height of the longitudinal rib.

In order to simplify the design of the coding assembly (eliminating the springs used in the prototype), improve its strength and make more difficult unauthorized opening of the locklike device by selecting appropriate alternatives of secrecy, it is preferred that each of the securing pins should move in the additional cavity by gravity forces.

It is preferred that all the recesses in the securing pins should made in the form of circular grooves.

This design allows a larger number of alternative positions of recesses over the length of the securing pins to be used in comparison with the recesses of the coding assembly according to US, A, 1,527,336 (for the respective geometrical dimensions). In turn, this allows the number of alternatives of secrecy of the present assembly to be increased sharply.

It is desirable that the side surface of the homing head be provided with annular grooves to interact with the securing pins, the cross-sectional profile of the grooves corresponding to the cross-sectional profile of the securing pins.

The circular grooves provided on the homing head allow free rotation of the cross bar within the body about the longitudinal axis of the main cavity and increase the reliability of the coding assembly, because the possibility of the locklike device being removed from the guarded object by mechanical means, for example, by sawing the cross bar by a hack saw is minimized.

In order to increase the safety of the coding assembly and reduce the possibility of dirt entering its inside cavities, it is preferred that the cross-sectional area of the homing head should be smaller than the cross-sectional area of the cross bar.

To limit the longitudinal displacement of the securing pins in the additional cavities, it is possible to secure on the body a cover having through holes which are intended to receive the securing pins , each of the holes communicating with the respective additional cavity and having a smaller cross-sectional area than the cross-sectional area of the additional cavity.

This design is required for padlock devices.

When the present coding assembly is used in stationary locklike devices, it is desirable, in order to limit the longitudinal displacement of the securing pins in the additional cavities, to arrange the body in a casing, the body being in this case provided with through holes which are designed to receive coding pins and each of which must communicate with the respective additional cavity and have a cross-sectional area smaller than the cross-sectional area of the additional cavity.

It is essential that the axis of each through hole be offset relative to the longitudinal axis of the respective additional cavity.

This design makes it more difficult to extract the securing pins from the body by drilling them out.

For more convenient operation, it is desirable that the coding pins of the key be provided on the bearing piece and be capable of angular turning relative to the piece.

It is advantageous to provide the coding pins of the key on the bearing piece for longitudinal displacement relative thereto in the direction of displacement of the securing pins.

This design makes it possible to make keys having universal coding pins, to reset the code to prevent unauthorized opening of the locklike devices should the key be lost, and to transmit information for opening the coding assembly without sending the key itself.

Whenever the locklike device is to be sealed, the end face portion of the homing head is to be arranged outside the body and a through hole bored therein.

BRIEF DESCRIPTION OF DRAWINGS

The present invention is further described in detail on the basis of specific embodiments thereof with reference to the accompanying drawings, wherein.

BEST MODES OF CARRYING OUT THE INVENTION

Figure 1:
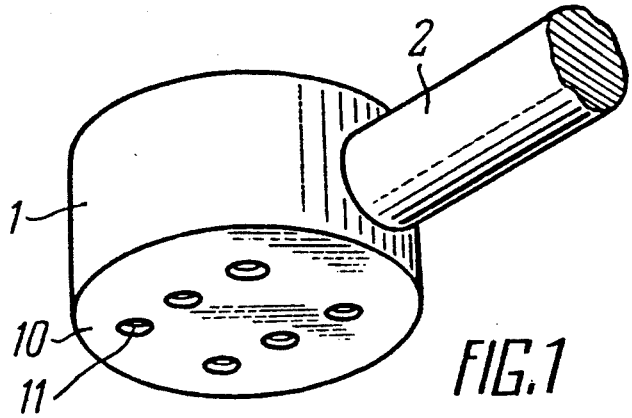
FIG.1 is a general view of the coding assembly used in padlock devices, according to the invention.

A coding assembly for locklike devices made according to the invention comprises a body 1 (FIG.1) in the form of a cylinder, for example, and a removable cylindrical cross bar 2. The body 1 is provided with a main cavity 3 (FIG.2) and additional cavities 4 communicating therewith. In a specific embodiment of the invention, the number of additional cavities is six.

The cross bar 2 (FIG.3) has a homing head 5 designed to be received in the main cavity 3 (FIG.2) and interact with securing pins 6, each of which is capable of limited longitudinal movement in the respective additional cavity 4. The securing pins 6 move within said cavities 4 by gravitational forces.

Figure 4:
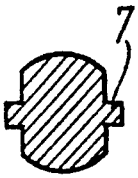
FIG.4 is a sectional view along IV—IV in FIG.3.
Figure 5:
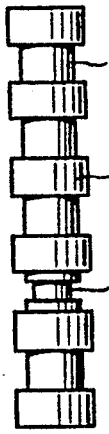
FIGS.5 and 9 show embodiments of a securing pin according to the invention.

The side surface of the homing head 5 is provided with at least one longitudinal rib 7. Two ribs are provided in a specific embodiment (FIG.4). Each of the securing pins 6 (FIG.5) is provided with a coding recess in the form of a circular groove 8, the cross-sectional profile of which corresponds to the cross-sectional profile of the longitudinal rib 7 (FIG.2), the depth of the circular groove 8 corresponding to the height of the longitudinal rib 7.

Each securing pin 6 is provided with at least one additional recess in the form of a circular groove 9, four in this specific embodiment. The cross-sectional profile of the additional circular groove 9 corresponds to the cross-sectional profile of the longitudinal rib 7, and the depth of this groove 9 is smaller than the height of said rib 7.

To prevent the securing pins 6 from falling out under the effect of gravity from the body 1, the body is provided with a cover 10 which is rigidly secured, for example, by welding. The cover 10 is provided with through holes 11 (FIG.1), each of which communicates with a respective additional cavity 4 (FIG.2) and has a cross-sectional area that is smaller than the cross-sectional area of the additional cavity 4. To prevent unauthorized extraction of the securing pins 6 from the additional cavities, for example, by drilling them out, the axis of each through hole 11 (FIG.1) in the cover 10 is offset relative to the longitudinal axis of the respective additional cavity 4 (FIG.2).

The side surface of the homing head 5 (FIG.3) is provided with circular grooves 12 designed to interact with the securing pins 6 (FIG.2), the cross-sectional profile of the grooves corresponding to the cross-sectional profile of the securing pins. The circular grooves 12 (FIG.3) allow free rotation of the cross bar 2 about the longitudinal axis within the main cavity 3 (FIG.3) of the body 1.

Figure 2:
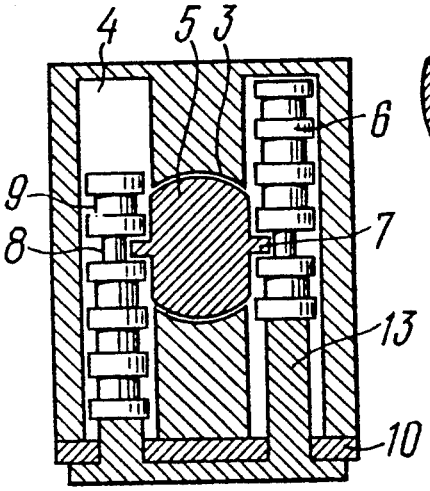
FIG.2 is a cross sectional view of the coding assembly shown in FIG.1, in a position in which the cross bar is unlocked.
Figure 3:
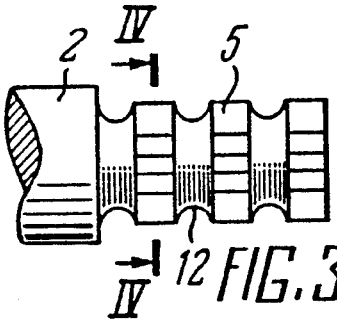
FIGS.3 and 11 show embodiments of the homing head of the cross bar according to the invention.
Figure 6:
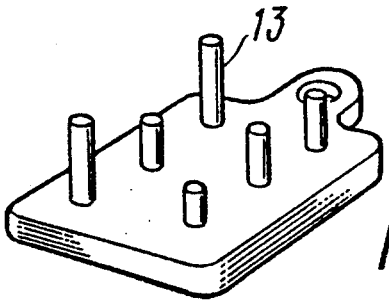
FIGS.6, 7, 8 and 13 show embodiments of a key according to the invention.
Figure 7:
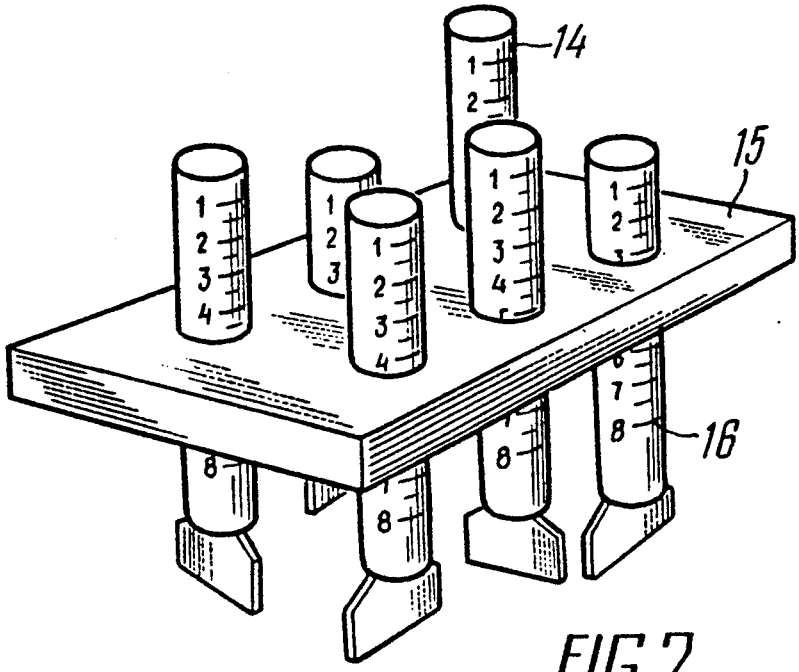

The coding assembly is provided with a key having coding pins 13 (FIG.6) intended to be received in the through holes 10 (FIG.1) and to interact with the respective securing pins 6 (FIG.2). Depending on the function of the locklike device, the key may have different designs. For example, to lock transport facilities (wagon or container) the suitable key has coding pins 14 (FIG.7) which are mounted on bearing pieces 15 for longitudinal displacement relative thereto in the direction of movement of the securing pins 6 (FIG.2). Each of the coding pins 14 (FIG.7) is provided with marks 16 for setting the coding pins 14 in the unlocked position. This design helps obviate the sending of the keys by transmitting code information in the shipment documents. This embodiment of the key allows the unlocking code to be reset to prevent unauthorized opening of the device.

Figure 8:
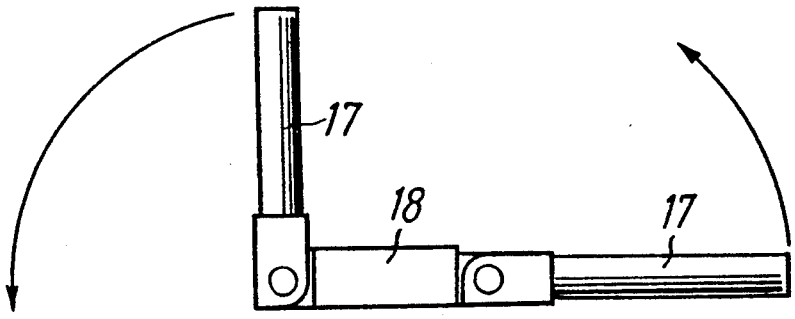

A key for locklike devices used for locking warehouses, garages and the like may be made in the form of coding pins 17 (FIG.8) provided on a bearing piece 18 for angular turning relative thereto. The height of each of the coding pins 17 corresponds to the code. This design provides additional convenience in use.

The coding assembly according to the invention operates as follows:

When locking the locklike device, the coding pins 13 (FIG.6) of the key are inserted in the holes 11 (FIG.1)

provided in the cover 10, in which case all the securing pins 6 (FIG.2) are set in a position, in which the coding recesses 8 in these securing pins 6 are placed in one plane to provide free passage therethrough for the ribs 7 of the homing head 5. Then the cross bar 2 (FIG.1) is inserted to the end of the body 1. After the key is removed, the securing pins 6 (FIG.2) go down by gravity to block the cross bar 2 (FIG.1) by engaging the circular grooves 12 (FIG.3) of its homing head 5. The cross bar 2 is unlocked in a similar manner.

The above-described embodiment of the coding assembly according to the invention is used in locklike devices such as padlocks and outer stationary devices. A distinctive feature of the latter is a casing (not shown) used to limit the longitudinal displacement of the securing pins 6 (FIG.2) in the body 1. In this case, the holes to receive the coding pins 13 of the key are made in the bottom of the body 1.

Figure 10:
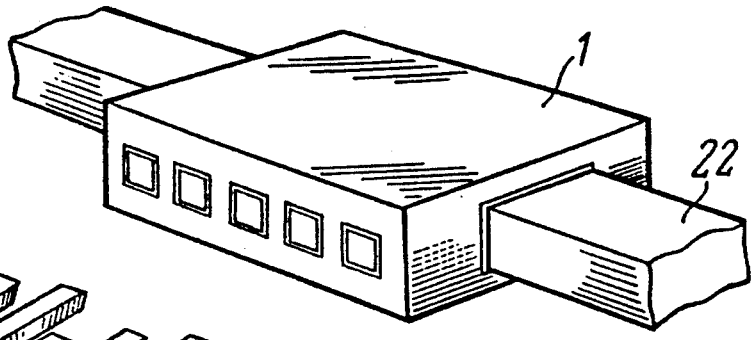
FIG.10 shows a complete coding assembly according to the invention for use in stationary locklike devices.
Figure 12:
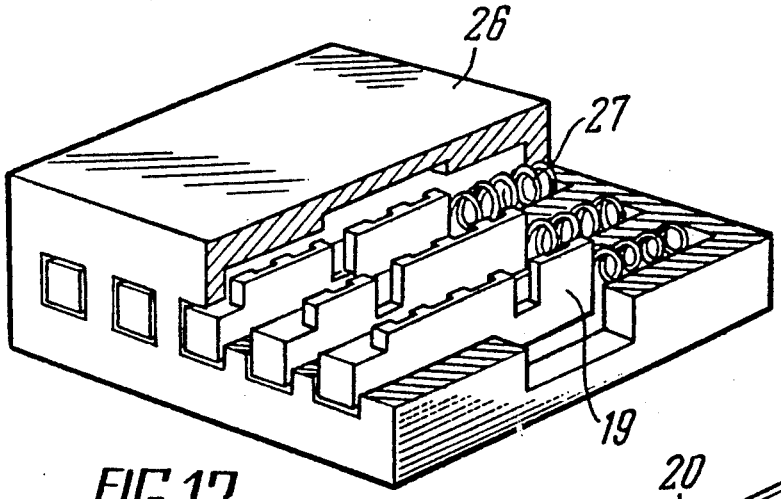
FIG.12 shows a coding assembly without a cross bar for stationary locklike devices, an angular cutout view.
Figure 11:
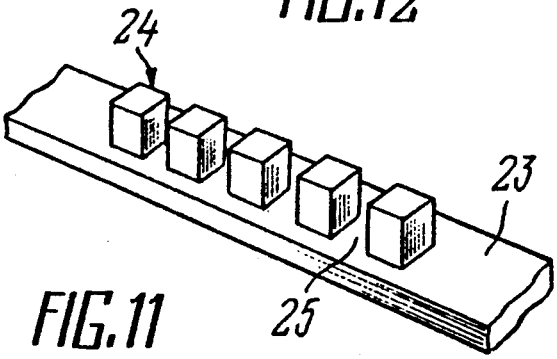
Figure 9:
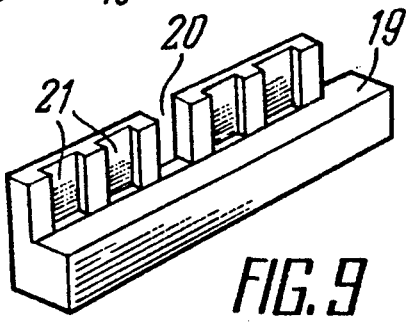

When the coding assembly is used in inner locklike devices of the superimposed type, such as for locking apartments, the coding recesses in the securing pins 19 (FIG.9) are made in the form of a through slot 20, and additional recesses in the form of blind slots 21. In this case, the cross bar 22 (FIG.10) has a rectangular shape, and the homing head 23 (FIG.11) is provided with one longitudinal rib 24, which has grooves 25 to receive the securing pins 19 (FIG.9). The longitudinal displacement of the securing pins 19 in the body 26 (FIG.12) having a rectangular shape is effected with the help of springs 27.

Figure 13:
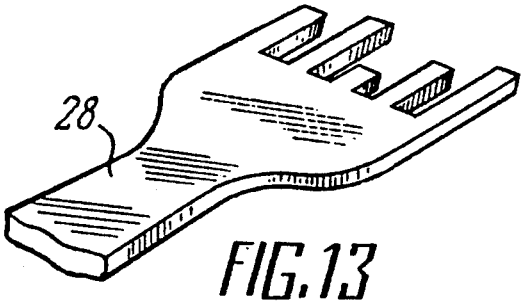

The coding assembly of this design is locked and unlocked by coding pins 28 of a key shown in FIG.13 which is similar to the one described above.

Figure 14:
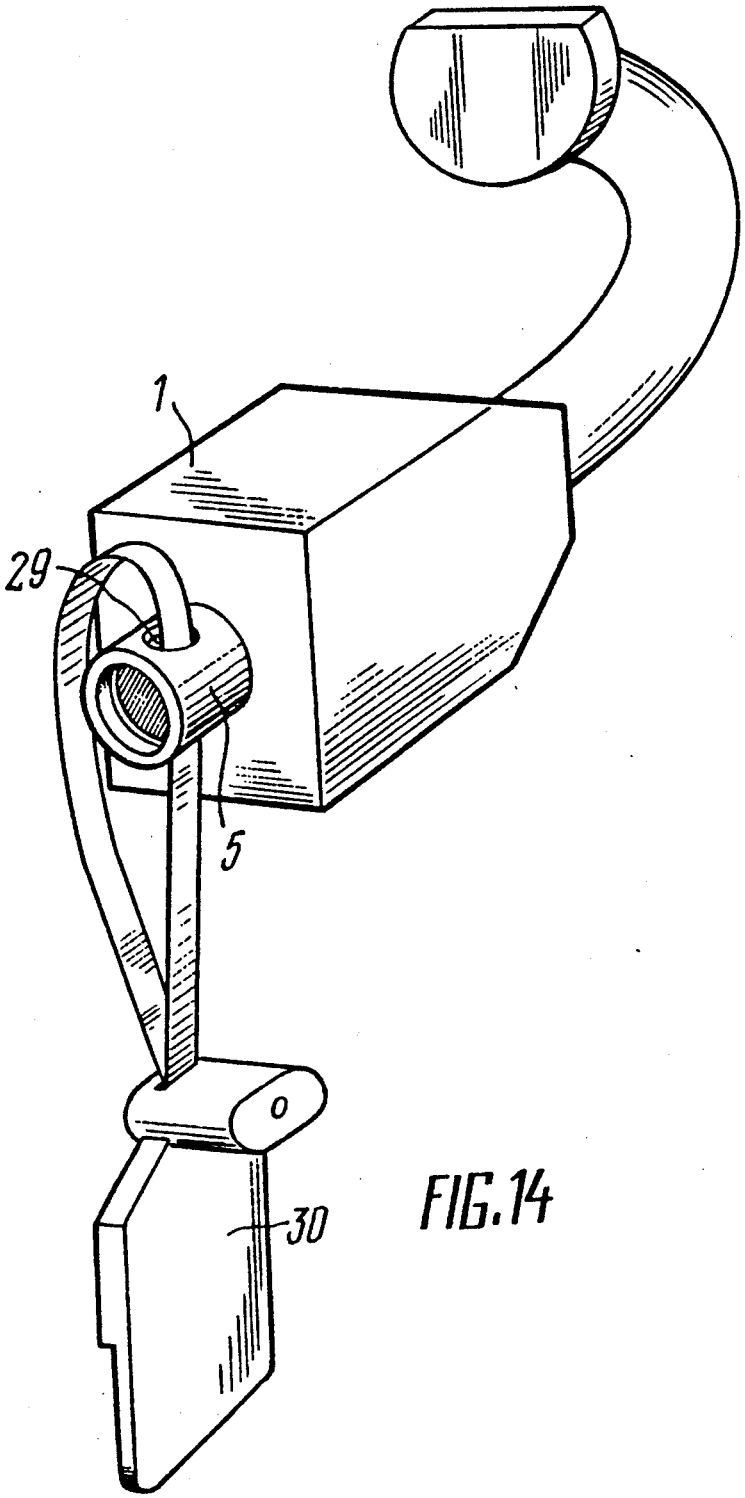
FIG.14 shows a complete coding assembly provided with a seal.

When the guarded object is to be sealed, the main cavity 3 (FIG.2) is of a through type, the homing head 5 being passed through the body 1 (FIG.14). The end face portion of the homing head 5 is provided with a through hole 29, through which a seal 30 is inserted.

The above-described coding assembly for a locklike device according to the invention has a simple design and does not require a high precision in manufacture. This coding assembly sharply increases the secrecy of the locklike device and practically obviates the possibility of unauthorized unlocking by jemmies or selection of alternatives, or by probing. Besides, the present coding assembly used in locklike devices increases the strength of the latter and makes more difficult unauthorized removal of the locklike device from the guarded object by using common tools (sledge hammer, crowbar, hack saw and the like). The present coding assembly is convenient in use, does not require repairs in the padlock embodiment, and minimizes the need to repair the coding assembly used in stationary locklike devices.

We claim:

1. A coding assembly of a locklike device, comprising:

a body;

a main cavity in said body;

additional cavities in said body, communicating with said main cavity, the axis of each of said additional cavities being perpendicular to the longitudinal axis of said main cavity;

securing pins, each of which is arranged for limited longitudinal displacement in each of said respective additional cavities, and wherein each of said securing pins moves within said respective additional cavities by gravity;

coding recesses, each of which is provided in the side surface of the respective one of said securing pins;

a removable cross bar;

a homing head of said cross bar designed to be received in said main cavity of said body and to interact with said securing pins;

at least one longitudinal rib provided on the side surface of said homing head and having a cross-sectional profile corresponding to the cross-sectional profile of said coding recesses, the depth of which corresponds to the height of said longitudinal rib;

at least one additional recess provided in the side surface of each of said securing pins and having a cross-sectional profile corresponding to the cross-sectional profile of said longitudinal rib, the depth of each additional recess being smaller than the height of said longitudinal rib;

a key;

coding pins of said key, designed to interact with said securing pins and to allow free movement of said homing head out of said body owing to their location in one plane passing through the longitudinal axis of said homing head and the longitudinal rib thereof.

2. A coding assembly according to claim 1, wherein all said recesses in said securing pins are made in the form of circular grooves.

3. A coding assembly according to claim 1, wherein the side surface of said homing head is provided with circular grooves which interact with said securing pins and have a cross-sectional profile corresponding to the cross-sectional profile of said securing pins.

4. A coding assembly according to claim 1, wherein to limit the longitudinal displacement of said securing pins in said additional cavities, a cover is rigidly secured to said body and provided with through holes to receive said coding pins, each of said holes communicating with the respective one of said additional cavities and having a cross-sectional area smaller than the cross-sectional area of said additional cavity.

5. A coding assembly according to claim 1, wherein to limit the longitudinal displacement of said securing pins in said additional cavities said body is located inside a casing, said body being provided with through holes to receive said coding pins, and each of said holes communicating with a respective one of said additional cavities and having a cross-sectional area smaller than the cross-sectional area of said additional cavity.

6. A coding assembly according to claim 1, wherein the axis of said said through hole is offset relative to the longitudinal axis of the respective one of said additional cavities.

7. A coding assembly according to claim 1, wherein said coding pins of said key are provided on a bearing piece for angular turning relative thereto.

8. A coding assembly according to claim 1, wherein said coding pins of said key are provided on the bearing piece for longitudinal displacement relative thereto in the direction of displacement of said securing pins.

9. A coding assembly of a locklike device, comprising:

a body;

a main cavity in said body;

additional cavities in said body, communicating with said main cavity, the axis of each of said additional cavities being perpendicular to the longitudinal axis of said main cavity;

securing pins, each of which is arranged for limited longitudinal displacement in each of said respective additional cavities;

coding recesses, each of which is provided in the side surface of the respective one of said securing pins;

a removable cross bar;

a homing head of said cross bar designed to be received in said main cavity of said body and to interact with said securing pins, and wherein the cross-sectional area of said homing head is smaller than the cross-sectional area of said cross-bar;

at least one longitudinal rib provided on the side surface of said homing head and having a cross-sectional profile corresponding to the cross-sectional profile of said coding recesses, the depth of which corresponds to the height of said longitudinal rib;

at least one additional recess provided in the side surface of each of said securing pins and having a cross-sectional profile corresponding to the cross-sectional profile of said longitudinal rib, the depth of each additional recess being smaller than the height of said longitudinal rib;

a key;

coding pins of said key, designed to interact with said securing pins and to allow free movement of said homing head out of said body owing to their location in one plane passing through the longitudinal axis of said homing head and the longitudinal rib thereof.

10. A coding assembly of a locklike device, comprising:

a body;

a main cavity in said body;

additional cavities in said body, communicating with said main cavity, the axis of each of said additional cavities being perpendicular to the longitudinal axis of said main cavity;

securing pins, each of which is arranged for limited longitudinal displacement in each of said respective additional cavities;

coding recesses, each of which is provided in the side surface of the respective one of said securing pins;

a removable cross bar;

a homing head of said cross bar designed to be received in said main cavity of said body and to interact with said securing pins, and wherein the end face position of said homing head is provided outside said body and has a through hole extending therethrough;

at least one longitudinal rib provided on the side surface of said homing head and having a cross-sectional profile corresponding to the cross-sectional profile of said coding recesses, the depth of which corresponds to the height of said longitudinal rib;

at least one additional recess provided in the side surface of each of said securing pins and having a cross-sectional profile corresponding to the cross-sectional profile of said longitudinal rib, the depth of each additional recess being smaller than the height of said longitudinal rib;

a key;

coding pins of said key, designed to interact with said securing pins and to allow free movement of said homing head out of said body owing to their location in one plane passing through the longitudinal axis of said homing head and the longitudinal rib thereof.

* * * * *